US006657479B2

(12) United States Patent
Rebmann

(10) Patent No.: US 6,657,479 B2
(45) Date of Patent: Dec. 2, 2003

(54) CONFIGURATION HAVING A CURRENT SOURCE AND A SWITCH CONNECTED IN SERIES THEREWITH

(75) Inventor: Volkmar Rebmann, München (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/972,325

(22) Filed: Oct. 5, 2001

(65) Prior Publication Data

US 2003/0048127 A1 Mar. 13, 2003

(30) Foreign Application Priority Data

Sep. 13, 2001 (DE) ..... 101 45 034

(51) Int. Cl.[7] ..... G05F 1/10; G05F 3/02
(52) U.S. Cl. ..... 327/538; 327/543; 323/315
(58) Field of Search ..... 327/538, 543, 327/148, 157; 323/311, 312, 315, 316

(56) References Cited

U.S. PATENT DOCUMENTS 3,982,172 A 9/1976 van de Plassche ..... 323/317
4,651,083 A 3/1987 Lachmann et al. ..... 323/316
4,706,013 A 11/1987 Kuo ..... 323/316
6,124,741 A * 9/2000 Arcus ..... 326/83
6,124,754 A * 9/2000 Afghahi ..... 323/315
6,160,432 A * 12/2000 Rhee et al. ..... 307/110
6,316,987 B1 * 11/2001 Dally et al. ..... 327/538

FOREIGN PATENT DOCUMENTS

DE 37 79 871 T2 5/1988
EP 0 169 388 A1 1/1986

* cited by examiner

*Primary Examiner*—Tuan T. Lam
(74) *Attorney, Agent, or Firm*—Laurence A. Greenberg; Werner H. Stemer; Gregory L. Mayback

(57) ABSTRACT

The configuration described is distinguished by the fact that it contains a control device which ensures that the potential which is established on the current-source side terminal of the switch when the latter is open has the value which it would have if the switch were to be closed, under otherwise unchanged conditions, and if the current output by the current source were to flow through said switch. As a result, it is possible for the current output by the configuration always to be as large as desired, in particular even immediately directly after the closure of the switches P2 and N1, more precisely exactly the current output by the current sources P1 and N2.

10 Claims, 2 Drawing Sheets

CONFIGURATION HAVING A CURRENT SOURCE AND A SWITCH CONNECTED IN SERIES THEREWITH

BACKGROUND OF THE INVENTION

Field of the Invention

The invention lies in the electronics and circuit technology fields. More specifically, the invention relates to a configuration with a current source and a switch connected in series with the current source.

A configuration of the generic type is illustrated in FIG. 2. The circuit of FIG. 2 contains four transistors P1, P2, N1 and N2 connected in series, and

- the first transistor P1 is a PMOS transistor, whose source terminal is connected to the positive pole VDD of a supply voltage supplying the configuration with power, and which is controlled by a signal icp_refp;
- the second transistor P2 is a PMOS transistor, whose source terminal is connected to the drain terminal of the first transistor P1, and which is controlled by a signal upq;
- the third transistor N1 is an NMOS transistor, whose drain terminal is connected to the drain terminal of the second transistor P2, and which is controlled by a signal down; and
- the fourth transistor N2 is an NMOS transistor, whose drain terminal is connected to the source terminal of the third transistor N1, whose source terminal is connected to the negative pole VSS of a supply voltage supplying the configuration with power, and which is controlled by a signal ipc_refn.

The signal upq controlling the transistor P2 is the output signal from an inverter INV1 which is formed by a PMOS is transistor P3 and an NMOS transistor N3 and which inverts a signal incr fed to it.

The signal down controlling the transistor N1 is the output signal from an inverter INV2 which is formed by a PMOS transistor P4 and an NMOS transistor N4 and which inverts the output signal fed to it by an inverter INV3 which is formed by a PMOS transistor P5 and an NMOS transistor N5 and which, for its part, inverts a signal decr fed to it.

The transistors P1 and N2 are driven by the signals icp_refp and icp_refn controlling them in such a way that they respectively form a current source, the currents output by these current sources being adjustable to the respectively desired values by way of the signals icp_refp and icp_refn controlling the transistors. For better clarity, the transistors P1 and N2 are also designated below as current sources P1 and N2.

The transistors P2 and N1 are driven by the signals upq and down (incr and decr) controlling them in such a way that they respectively form a switch. It is thereby possible for these switches to be opened and closed as a function of the signals upq and down, respectively. For better understanding, the transistors P2 and N1 are also referred to below as switches P2 and N1.

The configuration has an output terminal O, which is connected to a point lying between the switches P2 and N1 and via which an output signal icp is output.

From the above-described construction of the configuration, it becomes clear that the current generated by the current source P1, or the current generated by the current source N2, or no current is optionally output via the output terminal O. Stated more precisely:

- the current generated by the current source P1 is output if and as long as the switch P2 is closed (i.e., the transistor P2 forming the switch is turned on);

- the current generated by the current source N2 is output if and as long as the switch N1 is closed (i.e., the transistor N1 forming the switch is turned on); and
- no current is output if both switches P2 and N1 are open (the transistors P2 and N1 forming the switches are off).

The configuration shown in FIG. 2 is a current source which can be used universally. It is possible, with that current source, to output a current of any desired magnitude for any desired period and at any desired times.

However, this is true only in theory. In practice, problems can occur which restrict the possible uses of the configuration. These problems are that, from time to time, following the closure of the switches P2 and N1, a current is output for a certain time which is higher or lower than the current actually to be output (than the current output by the current sources P1 or N2); experience shows that the current output after the closure of the switches can, for a certain time, be higher or lower by up to several hundred mA than the current actually to be output.

Inter alia, this results in the configuration shown in FIG. 2 not being usable

- if very short current pulses of defined magnitude are needed, for example if a current of 10 mA is needed for a duration of 0.5 ns or less; and/or
- if (irrespective of the duration during which the configuration outputs a current) larger deviations of the current output by the configuration from the current actually to be output are impermissible.

SUMMARY OF THE INVENTION

It is accordingly an object of the invention to provide a current source and switch configuration, which overcomes the above-mentioned disadvantages of the heretofore-known devices and methods of this general type and wherein the current output by the configuration is always as large as desired, in particular also immediately after the closure of the switch.

With the foregoing and other objects in view there is provided, in accordance with the invention, a circuit configuration, comprising:

- a current source and a current switch connected in series with the current source, the current switch having a current-source side terminal;
- a control device configured to ensure that a potential established at the current-source side terminal of the current switch, when the current switch is open, has a value equal to a value the potential would have if the current switch were closed, under otherwise unchanged conditions, and if a current output by the current source were to flow through the current switch.

In other words, the configuration according to the invention is defined by the fact that it contains a control device which ensures that the potential established on the current-source side terminal of the switch, when the latter is open, has the value which it would have if the switch were closed, under otherwise unchanged conditions, and if the current output by the current source were to flow through the switch.

This rules out the situation where the potential established on the current-source side terminal of the switch rises in phases wherein the switch is open. Preventing the potential rise eliminates the cause responsible for an increased current flowing when the switch is closed.

In the case of conventional configurations of the type of FIG. 2, during phases wherein the switch is open, a potential rise inevitably occurs on the current-source side terminal of the switch. The reason for this is that the current source also outputs a current after the switch has been opened. The current which continues to flow results in an increased amount of charge accumulating in the section of line running between the current source and the switch, and this in turn results in the potential established there rising. The increased potential, more precisely the increased amount of charge causing this potential increase, has the effect that when the switch is closed, not only does the current output by the current source flow but, in addition, an additional current resulting from the decay of the increased amount of charge, the speed at which the additional current decays depending on the capacitance of the section of line running between the current source and the switch.

The fact that, in the configuration according to the invention, the potential that is established on the current-source side terminal of the switch is brought to a specific value and/or kept at a specific value means that no increased amount of charge can accumulate in the section of line running between the current source and the switch, and, consequently, no additional current can flow either when the switch is closed.

The setting, carried out described, of the potential that is established on the current-source side terminal of the switch means that the conditions are satisfied which must be satisfied in order that the current that flows through the switch when it is closed is exactly the current output by the current source and, consequently, the current output from the configuration is exactly the current output by the current source. Because this condition is satisfied at all times, that is to say including the time of closing the switch (whenever this takes place), the current that flows through the switch from the time the latter is closed is precisely the current output by the current source, so that the current output from the configuration is always precisely the current output by the current source, that is to say even immediately after the closure of the switch.

Other features which are considered as characteristic for the invention are set forth in the appended claims.

In accordance with an added feature of the invention, the control device includes a control switch corresponding to the current switch, the control switch having a first terminal connected to the current-source side terminal of the current switch, and the control switch of the control device is connected and wired such that, when the control switch is closed, a current flowing therethrough equals a current flowing through the current switch when the switch is closed.

In accordance with an additional feature of the invention, the current flowing through the control switch of the control device, when the control switch is closed, is the current output by the current source.

In accordance with another feature of the invention, the current switch provided outside the control device and the control switch of the control device are driven such that the control switch of the control device is open when the current switch is closed, and that the control switch of the control device is closed when the current switch is open.

In accordance with a further feature of the invention, a potential established at a terminal of the control switch opposite of and not connected to the current-source side terminal of the current switch corresponds to a potential established at a terminal of the current switch not connected to the current source.

In accordance with again an added feature of the invention, a voltage follower is connected to set the potential established on the terminal of the control switch that is not connected to the current-source side terminal of the current switch.

In accordance with again an additional feature of the invention, the voltage follower has an input terminal connected to the terminal of the control switch that is not connected to the current-source side terminal of the current switch, and an output terminal connected to the terminal of the control switch that is not connected to the current-source side terminal of the current switch.

In accordance with again another feature of the invention, the voltage follower has first and second transistors connected in series, the first transistor is a transistor arranged in a source follower circuit, and the second transistor is used as a diode.

In accordance with again a further feature of the invention, the first transistor has a gate terminal forming an input terminal of the voltage follower, and the second transistor has a drain terminal forming an output terminal of the voltage follower.

In accordance with a concomitant feature of the invention, the current switch and the control switch are each formed by a transistor.

Although the invention is illustrated and described herein as embodied in a configuration having a current source and a switch connected in series therewith, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
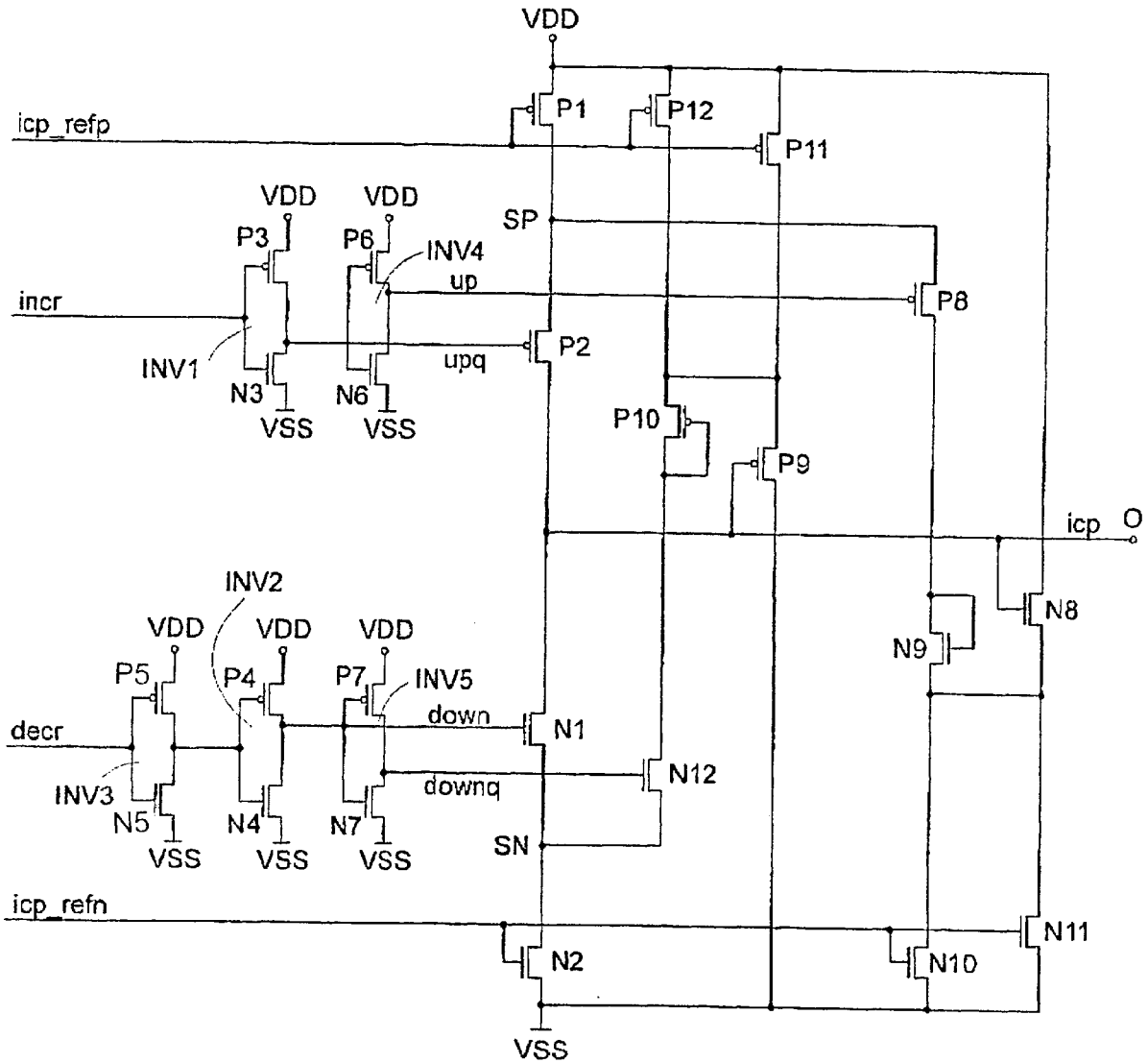
FIG. 1 is a circuit diagram showing the construction of the configuration having a current source and a switch connected in series therewith in accordance with the invention.

Referring now to the figures of the drawing in detail, it is noted that the exemplary configuration described below with reference to FIG. 1 is a constituent part of an integrated circuit. It can, however, also be implemented in a conventional, that is to say non-integrated, circuit.

Figure 2:
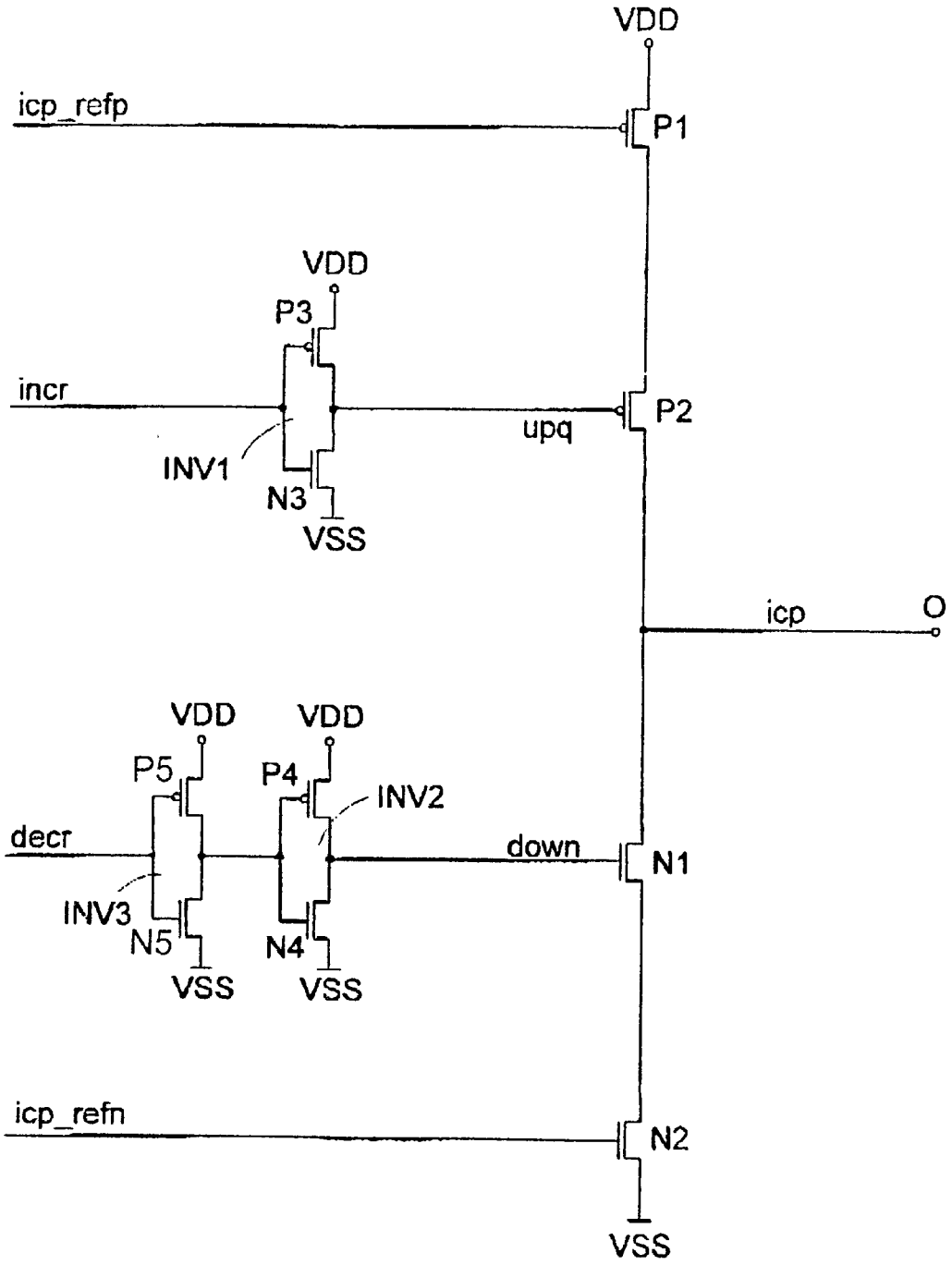
FIG 2 PRIOR ART
FIG. 2 is a circuit diagram showing the construction of a prior art configuration having a series circuit with a current source and a switch.

The configuration described is based on the configuration shown in FIG. 2 and described at the beginning with reference thereto. Components which are designated by the same reference symbols are identical or mutually corresponding components.

Apart from the components contained in the configuration according to FIG. 2, the configuration shown in FIG. 1 additionally contains

- a first control device, which ensures that the potential established on the current-source side terminal of the switch P2 when the latter is open, more precisely at a node point designated by the reference symbol SP in FIG. 1 and located between the current source P1 and the switch P2, has the value which it would have if the switch P2 were to be closed under otherwise unchanged conditions and if the current output by the current source P1 were to flow through it; and a second control device, which ensures that the potential which is established on the current-source side terminal of the switch N1 when the latter is open, more precisely at a node point designated by the reference symbol SN in FIG. 1 and located between the current source N2 and the switch N1, has the value which it would have if the switch N1 were to be closed under otherwise unchanged conditions and if the current output by the current source N2 were to flow through it.

The first control device contains, in addition to a series of further components, a PMOS transistor P8, which has identical characteristics to the transistor P2 forming the switch P2. Since, as will be explained in more detail below, this transistor P8 is driven, like the transistor P2, in such a way that it acts as a switch, it is also referred to below as switch P8.

On the source side, the transistor P8 is connected to the node point SP and is wired up to the remaining components of the first control device in such a way that during phases during which the switch formed by the transistor P2 is open, that current flows through it which would flow through the switch P2 under the prevailing conditions if that switch were closed. Since this current in the steady state is precisely the current output by the current source P1, the node point SP is automatically brought by the transistor P8 to the potential which that transistor would have if the current generated by the current source P1 were to flow through the switch P2.

As opposed to this, in the case of conventional configurations of the type of FIG. 2, during phases wherein the switch P2 is open, a potential rise inevitably occurs on the current-source side terminal of that switch. This is because the current source P1 outputs a current even after the opening of the switch P2. The result of the current which continues to flow is that an increased amount of charge accumulates in the section of line running between the current source and the switch, and this in turn has the result that the potential established at the node point SP rises. The increased potential, more precisely the increased amount of charge causing this potential increase, has the effect that when the switch P2 is closed, it is not only the current output by the current source P1 which flows but, in addition, an additional current that results from the decay of the increased amount of charge, the speed at which the additional current decays depending on the capacitance of the section of line running between the current source and the switch.

The fact that, in the configuration according to FIG. 1, the potential that is established on the current-source side terminal of the switch P2 is brought to a specific value and/or kept at a specific value means that no increased amount of charge can accumulate in the section of line running between the current source P1 and the switch P2, and, consequently, no additional current can flow either when the switch is closed.

This has the positive effect that when the switch P2 is closed, the current which flows through it from the beginning is that which is output by the current source P1, that is to say precisely the current which is intended to flow through it.

The transistor P8 is driven by a signal up, which runs in complementary fashion to the signal upq controlling the transistor P2. The signal upq is the output signal from an inverter INV4 formed by a PMOS transistor P6 and an NMOS transistor N6. The inverter INV4 receives as input signal the signal upq generated by the inverter INV1 and uses it to generate the signal up, which is the inverse of the signal upq.

As a result of the complementary driving of the transistors P2 and P8, the transistor P8 is on (the switch formed thereby is closed) only if and as long as the transistor P2 is off (if the switch formed thereby is open); in the on state of the transistor P2 (in the closed state of the switch formed thereby), the transistor P8 turns off (the switch formed thereby is closed), and can therefore not exert any influence on the states prevailing in the configuration or on the processes proceeding there.

The current flows through the transistor P8 via an NMOS transistor N9 connected in series with the transistor P8, an NMOS transistor N10 connected in series with the transistor N9 and an NMOS transistor N11 connected in parallel with the transistor N10 to the negative pole VSS of the supply voltage supplying the configuration with power.

The transistors N10 and N11 are transistors which correspond to the transistor N2, that is to say have the same characteristics as the transistor N2, and are also driven by the signal icp_refn, like the transistor N2. The transistors N10 and N11 therefore form current sources corresponding to the current source N2.

The transistor N9 acts as a diode.

The transistors N9 to N11 also have still further functions, which will be discussed in more detail later.

In addition to the components previously described, the first control device further contains means which ensure that the current which flows through the transistor P8 is exactly that which would flow through the transistor P2 if it were just on (if the switch formed thereby were closed).

In the example considered, this is achieved by the aforementioned means ensuring that the potential established at the drain terminal of the transistor P8 is the same as the potential which would be established at the drain terminal of the transistor P2 if it were just on (if the switch formed thereby were closed).

In the exemplary embodiment, this is achieved by a voltage follower or by a device acting as a voltage follower. For completeness, it should be noted that voltage follower designates circuits which have an input terminal and an output terminal and wherein the output voltage is equal to the input voltage.

In the exemplary embodiment, this voltage follower is formed by an NMOS transistor N8 and the NMOS transistor N9 already mentioned.

The transistor N8 connects the drain terminal to the positive pole VDD of the supply voltage supplying the configuration with power, connects the gate terminal to the output terminal O of the configuration, and connects the source terminal to the source terminal of the transistor N9, and via the transistors N10 and N11, to the negative pole VSS of the supply voltage supplying the configuration with power.

The transistor N9 connects the drain terminal to the drain terminal of the transistor P8, connects the gate terminal to the drain terminal, and connects the source terminal to the source terminal of the transistor N8, and via the transistors N10 and N11, to the negative pole VSS of the supply voltage supplying the configuration with power.

The input terminal of the voltage follower formed by the transistors N8 and N9 is the gate terminal of the transistor N8, and the output terminal of the voltage follower is the drain terminal of the transistor N9.

It should be clear that voltage followers implemented in another way can also be used. For example, it would be conceivable to use an operational amplifier as a voltage follower, of which the output terminal and the inverting input terminal are connected to each other. In that regard, the term "voltage follower" as used in the claims should be understood as any circuit device or combination of elements which fulfills the function of a voltage follower.

In this context, however, it should be pointed out that in general the voltage follower implementation used in the configuration according to FIG. 1 is to be given preference. A voltage follower implemented in this way operates at maximum speed and without stability problems. In the case of fed-back operational amplifiers, on the other hand, there are often stability problems. Although these can be eliminated by appropriate compensation of the operational amplifier, the result of compensation is that the operational amplifier reacts more slowly to changes. Therefore, and because both the provision of an operational amplifier and the compensation measures are associated with a comparatively high expenditure, the use of a fed-back operational amplifier as a voltage follower is generally not the optimum solution.

With the aid of the voltage follower, the potential established on the drain terminal of the transistor P8 is brought to the value of the potential established on the output terminal O of the configuration (and therefore also on the drain terminal of the transistor P2).

As a result, the potentials which are established on all the terminals of the transistor P8 are exactly the potentials which would be established on the transistor P2 if the latter were on. This results in the current flowing through the transistor P8 being exactly that which would also flow through the transistor P2 if it were on.

As a result, the node point SP always, that is to say both in phases wherein the switch P2 is closed and in phases wherein the switch P2 is open, has the same current flowing through it, more precisely the current output by the current source P1. The result of this is that neither the opening nor the closing of the switch P2 can result in changes to the potential established at the node point, and that the current which flows through the switch S2 immediately after the same has been closed is that which is intended to flow through it.

The second control device comprises PMOS transistors P7, P9, P10, P11 and P12, and NMOS transistors N7 and N12, and is constructed in an analogous way to the first control device, so that a description can be dispensed with.

The configuration shown in FIG. 1 can be modified from various points of view. For example, it is possible to use other transistors, for example bipolar transistors or other transistors, instead of the transistors used in the present case. Of course, the current sources and/or the switches can also be implemented in a different way than that in the configuration according to FIG. 1.

The configuration described above makes it possible, regardless of the details of the practical implementation, for the current output by the configuration always to be as large as desired, in particular even immediately after the closure of the switches P2 and N1, more precisely exactly the current output by the current sources P1 and N2.

I claim:

1. A circuit configuration, comprising:

a current source and a current switch connected in series with said current source, said current switch having a current-source side terminal;

a control device electrically connected to said current switch so as to establish a potential at said current-source side terminal of said current switch, when said current switch is open, which has a value equal to a value the potential would have when the current switch is closed, under otherwise unchanged conditions, and when a current output by said current source flows through said current switch, said control device including a control switch that is similar to said current switch, said control switch having a first terminal connected to said current-source side terminal of said current switch and being connected and wired such that, when said control switch is closed, a current flows therethrough equals a current flowing through said current switch when said current switch is closed.

2. The configuration according to claim 1, wherein said current switch is connected outside said control device.

3. The configuration according to claim 1, wherein the current flowing through said control switch of said control device, when said control switch is closed, is the current output by said current source.

4. The configuration according to claim 2, wherein the current switch provided outside said control device and said control switch of said control device are driven such that said control switch of said control device is open when said current switch is closed, and that said control switch of said control device is closed when said current switch is open.

5. The configuration according to claim 2, wherein a potential established at a terminal of said control switch opposite of and not connected to said current-source side terminal of said current switch corresponds to a potential established at a terminal of said current switch not connected to said current source.

6. The configuration according to claim 5, which comprises a voltage follower connected to set the potential established on the terminal of said control switch that is not connected to said current-source side terminal of said current switch.

7. The configuration according to claim 6, wherein said voltage follower has an input terminal connected to the terminal of said current switch that is not connected to said current-Source side terminal of said current switch, and an output terminal connected to the terminal of said control switch that is not connected to said current-source side terminal of said current switch.

8. The configuration according to claim 6, wherein said voltage follower comprises first and second transistors connected in series, said first transistor is a transistor arranged in a source follower circuit, and said second transistor is used as a diode.

9. The configuration according to claim 8, wherein said first transistor has a gate terminal forming an input terminal of said voltage follower, and said second transistor has a drain terminal forming an output terminal of said voltage follower.

10. The configuration according to claim 1, wherein said current switch and said control switch are respective transistors.

* * * * *